US008736194B2

(12) United States Patent
Kawai et al.

(10) Patent No.: US 8,736,194 B2
(45) Date of Patent: May 27, 2014

(54) LED DIMMER CIRCUIT

(75) Inventors: Shuhei Kawai, Ota (JP); Tomoyuki Goto, Ota (JP); Feng Xu, Kiryu (JP)

(73) Assignee: Semiconductor Components Industries, LLC, Phoenix, AZ (US)

( * ) Notice: Subject to any disclaimer, the term of this patent is extended or adjusted under 35 U.S.C. 154(b) by 71 days.

(21) Appl. No.: 13/432,798

(22) Filed: Mar. 28, 2012

(65) Prior Publication Data

US 2012/0249000 A1 Oct. 4, 2012

(30) Foreign Application Priority Data

Mar. 29, 2011 (JP) ..... 2011-073265

(51) Int. Cl.
*H05B 37/02* (2006.01)

(52) U.S. Cl.
USPC ..... 315/291; 315/200 R; 315/224; 315/307; 315/308

(58) Field of Classification Search
USPC ..... 315/119, 121, 194, 200 R, 224, 225, 315/246, 291, 294, 297, 307, 308, 312
See application file for complete search history.

(56) References Cited

U.S. PATENT DOCUMENTS

2011/0193488 A1* 8/2011 Kanamori et al. ..... 315/209 R
2011/0199793 A1* 8/2011 Kuang et al. ..... 363/21.13
2011/0285301 A1* 11/2011 Kuang et al. ..... 315/200 R

FOREIGN PATENT DOCUMENTS

JP 2010-198943 A 9/2010

OTHER PUBLICATIONS

English Patent Abstract of JP2010198943 from esp@cenet, published Sep. 9, 2010, 1 page.

* cited by examiner

*Primary Examiner* — Douglas W Owens
*Assistant Examiner* — Thai Pham
(74) *Attorney, Agent, or Firm* — Rennie William Dover

(57) ABSTRACT

A TRIAC dimmer gates an AC waveform from an AC power source in proportion to a control signal and outputs a TRIAC pulse having part of the waveform missing. The TRIAC pulse is rectified and is applied to an LED array and the drive current flowing to the LED array is detected at a current detection resistor. The drive current value and a predetermined value are compared at a comparator and in accordance with the comparison result thereof the control transistor is turned off. Then, the TRIAC pulse is converted to a DC voltage signal and in accordance with the obtained DC voltage signal the drive current value or the predetermined value input by the comparator are changed. Furthermore, instead of the TRIAC pulse, a PWM pulse supplied from an external source may also be utilized.

18 Claims, 4 Drawing Sheets

LED DIMMER CIRCUIT

CROSS-REFERENCE TO RELATED APPLICATION(S)

The present application claims priority pursuant to 35 U.S.C. §119(a) to Japanese Patent Application No. 2011-073265, filed on Mar. 29, 2011, the contents of which is hereby incorporated by reference in its entirety.

BACKGROUND

1. Field of the Invention

One or more embodiments of the present invention relate to a light emitting diode (LED) dimmer circuit for dimming, in accordance with a control signal, an LED illuminated by an alternating current (AC) power source.

2. Background Art

Heretofore, triode for alternating current (TRIAC) dimmers were used for adjusting the brightness of illuminating lamps. The TRIAC dimmer gates the AC waveform, such as from a common commercial 100V AC power source, at a proportion according to a control signal, which is input such as from a switch, and outputs a TRIAC pulse having part of the waveform missing. Therefore, by directly applying the TRIAC pulse to a light bulb, for example, the brightness of the light bulb can be controlled to a brightness corresponding to the control signal.

The TRIAC dimmer is widely common since dimming can be performed with a relatively simple configuration. On the other hand, as LEDs (Light Emitting Diode) have become to be utilized for lighting, the TRIAC dimmer is also used in the dimming for LEDs.

An example is disclosed in Japanese Patent Laid-Open Publication No. 2010-198943.

Furthermore, instead of the TRIAC dimmer, pulse width modulation (PWM) control of LEDs is also known.

Here, compared to a light bulb, for example, an LED has higher sensitivity with respect to current. Thus, when the TRIAC pulse from a TRIAC dimmer is not stable (for example, when the pulse voltage is different at every half period of the alternating current (AC)), flickering appears in the LED. In particular, when the conduction angle of the TRIAC pulse is narrow, flickering is likely to appear. Furthermore, in the case of PWM control, flickering appears if the PWM frequency is low.

SUMMARY OF THE INVENTION

One or more embodiments of the present invention initially convert a pulse for dimming control to DC (direct current) voltage and on the basis of the DC voltage controls the on and off operation of a control transistor.

DETAILED DESCRIPTION

One or more embodiments of the present invention will be described hereinafter with reference to the attached drawings.

Figure 1:
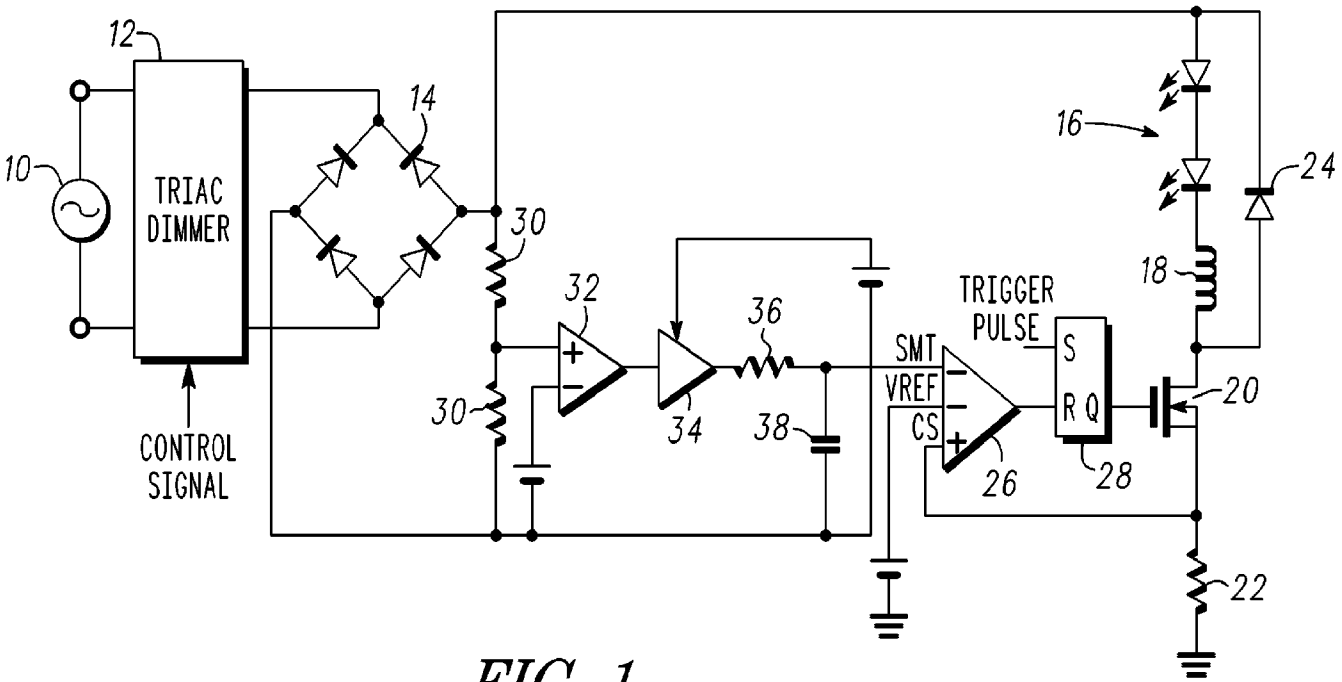
FIG. 1 shows a configuration of an embodiment.

FIG. 1 shows a configuration of an embodiment. An AC power source 10, for example, is a 100 V, 50 Hz (or 60 Hz) commercial power source available from a household outlet. The AC power from the AC power source 10 is supplied to a TRIAC dimmer 12. The TRIAC dimmer 12 removes part of the AC waveform from the AC power source 10 to generate a TRIAC pulse in accordance with a separately supplied control signal for the supplied power. For example, if the control signal is for setting the power to 50%, 50% of the AC waveform of one period is cut. In this case, out of one period of the AC waveform, cutting 1° to 90° and 180° to 270° sets the power to 50%. This is easily accomplished, for example, by a gate circuit.

The TRIAC pulse from the TRIAC dimmer 12 is supplied to a full wave rectifier 14. The full wave rectifier 14 uses a rectifying device, such as a diode, to perform conversion to a waveform where the negative side of a sine waveform is inverted to the positive side. It should be noted that instead of the full wave rectifier 14, a half wave rectifier may be used. When a half wave rectifier is used, the negative side of the sine waveform is removed and only the positive side of the waveform results. However, this is not a problem for the power supply for an LED array 16.

The forward bias output terminal of the full wave rectifier 14 is connected to the anode side terminal of the LED array 16 formed from a predetermined number of one or more LEDs connected in series. To the cathode terminal of the LED array 16 is connected one end of a coil 18 and the other end of the coil 18 is connected to ground via a control transistor 20 and a current detection resistor 22. Furthermore, to the connection between the coil 18 and the control transistor 20 is connected an anode of a diode 24, and the cathode of the diode 24 is connected to the connection between the LED array 16 and the forward bias output terminal of the full wave rectifier 14.

A voltage CS at the connection between the current detection resistor 22 and the control transistor 20 is input by a positive input terminal of a comparator 26. To a first negative input terminal of the comparator 26 is input a reference voltage Vref and the comparator 26 outputs an H level when the voltage at the current detection point exceeds the reference voltage Vref.

The output of the comparator 26 is input by a reset terminal of a flip-flop 28. To the set terminal of the flip-flop 28 is supplied a trigger pulse having a sufficiently high frequency compared to the TRIAC pulse. Then, the Q output of the flip-flop 28 is connected to the gate of the control transistor 20. Therefore, when the trigger pulse is applied, the control transistor 20 enters an on state.

With the control transistor 20 in the on state, the output from the full wave rectifier 14 is applied to the coil 18 via the LED array 16. When the voltage CS at the current detection terminal from current flowing toward ground via the coil 18 exceeds the reference voltage Vref, the control transistor 20 turns on. Then, at this time, current continues to the LED array 16 via the diode 24 due to the energy stored in the coil 18. This operation repeats every half period of the TRIAC pulse and the amount of emitted light from the LED array 16 is controlled by the conduction angle (duty) of the TRIAC pulse.

In this circuit, if the TRIAC pulse from the TRIAC dimmer 12 is unstable and the pulse voltage at every half period is different, for example, the timing where the control transistor 20 turns off differs every half period causing the amount of emitted light of the LED array 16 to change and flickering to occur.

Therefore, in the embodiment, a second negative input terminal is provided in the comparator 26 to where a voltage SMT, which becomes a second reference voltage, is input. The voltage SMT will be described.

The output of the full wave rectifier 14 is adjusted to a predetermined voltage by voltage divider resistors 30 and 30 and input by a positive input terminal of a comparator 32. The negative input terminal of the comparator 32 inputs a predetermined reference voltage and the comparator 32 outputs an H level when the output of the full wave rectifier 14 is greater than or equal to a predetermined value. After a predetermined DC shift by an amplifier 34, the output of the comparator 32 charges a capacitor 38 via a resistor 36. Namely, the output of the amplifier 34 is supplied to one terminal of the capacitor 38 via the resistor 36 and the other terminal of the capacitor 38 is connected to the reverse bias output terminal of the full wave rectifier 14. The lower terminal of the voltage divider resistor is also connected to the reverse bias output terminal of the full wave rectifier 14 and the reference voltage input by the negative input terminal of the comparator 32 also is formed by the voltage (ground voltage) of the reverse bias output terminal of the full wave rectifier 14 as a reference.

Then, the voltage at the connected end of the resistor 36 and the capacitor 38 is supplied to the second negative input terminal of the comparator 26 as the voltage SMT. The voltage SMT has the voltage value determined with respect to conduction angle of the TRIAC pulse by the resistance value of the voltage divider resistors 30 and 30, the reference voltage value that is input by the negative input terminal of the comparator 32, and a DC offset amount in the amplifier 34, and the time constant changes according to the resistance value of the resistor 36 and the capacitance value of the capacitor 38. However, since the TRIAC pulse is converted to DC voltage from the integration circuit formed from the resistor 36 and the capacitor 38, the voltage becomes independent of changes in the voltage every half period. Therefore, the lighting of the LED array 16 each time can be made uniform and the occurrence of flickering can be suppressed. Furthermore, when the conduction angle of the TRIAC pulse is narrow, the voltage SMT also becomes small, the control transistor 20 turns off at a relatively fast timing, and an appropriate current supply for the LED array 16 can be performed. Moreover, the reference voltage Vref is input by the first negative input terminal of the comparator 26 and if the voltage SMT becomes higher than the reference voltage Vref, the control transistor 20 turns off when the voltage CS exceeds the reference voltage Vref.

Although the offset amount changes if the comparator 32 is omitted, in this case the offset amount at the amplifier 34 may be adjusted.

Figure 2:
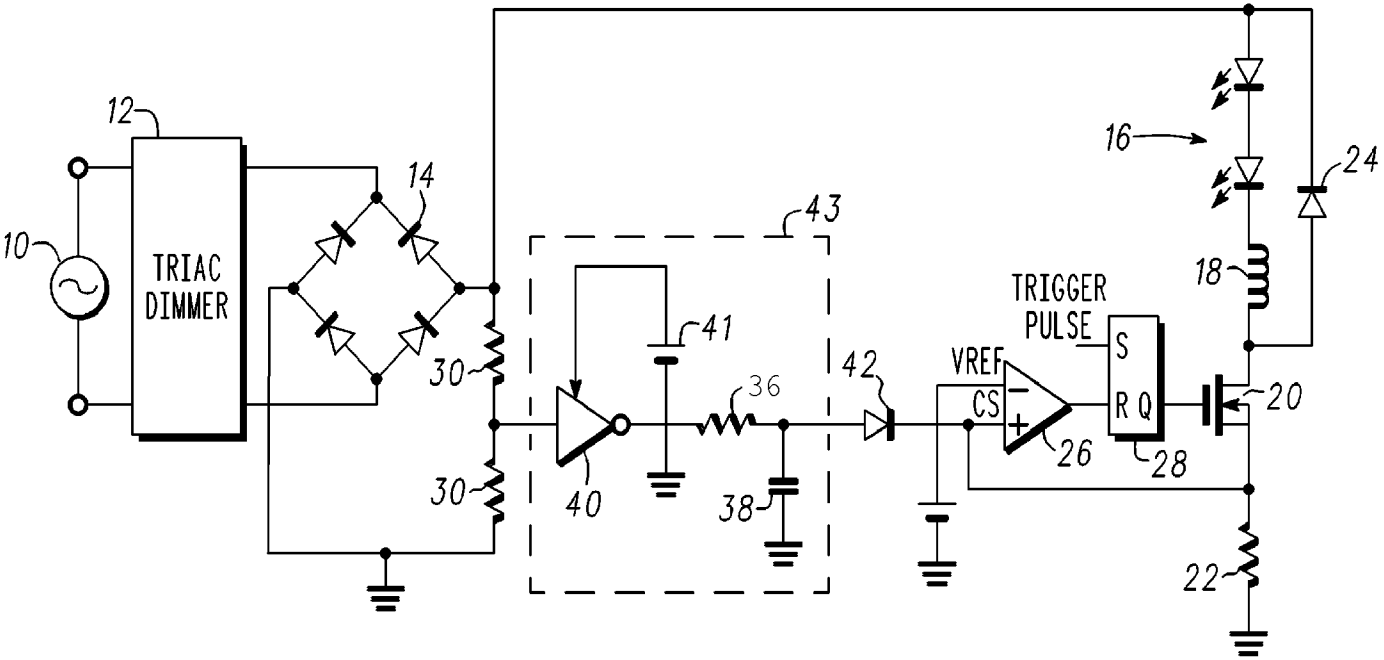
FIG. 2 shows a configuration of another embodiment.

FIG. 2 shows another embodiment. In this configuration, the output voltage of the voltage divider resistors 30 and 30 is inverted at an inverter 40 and also appropriately sets the offset amount, then charges the capacitor 38 via the resistor 36. It should be noted that inverter 40, the offset voltage source 41, resistor 34, and capacitor 38 cooperate to form a converter circuit 43. Converter circuit 43 is coupled to current detection resistor 22 through a diode 42, which diode 42 may be referred to as a change circuit. Namely, the charging voltage of the capacitor 38 changes according to the conduction angle of the TRIAC and is superimposed on the detected voltage CS. Therefore, control is performed to raise the CS voltage when the conduction angle of the TRIAC is narrow and lower the CS voltage when the conduction angle is wide. Thus, the CS voltage can be raised to immediately reach the reference voltage Vref when the conduction angle is narrow so that the current flowing to the LED array 16 can be reduced. Conversely, the CS voltage can be lowered to reach the reference voltage Vref at a slower rate when the conduction angle is wide so that the current flowing to the LED array 16 is sufficient.

In this manner, by converting the TRIAC pulse to DC voltage and adding the voltage to the CS voltage, the TRIAC pulse at each time can be prevented from becoming a cause of flickering.

Figure 3:
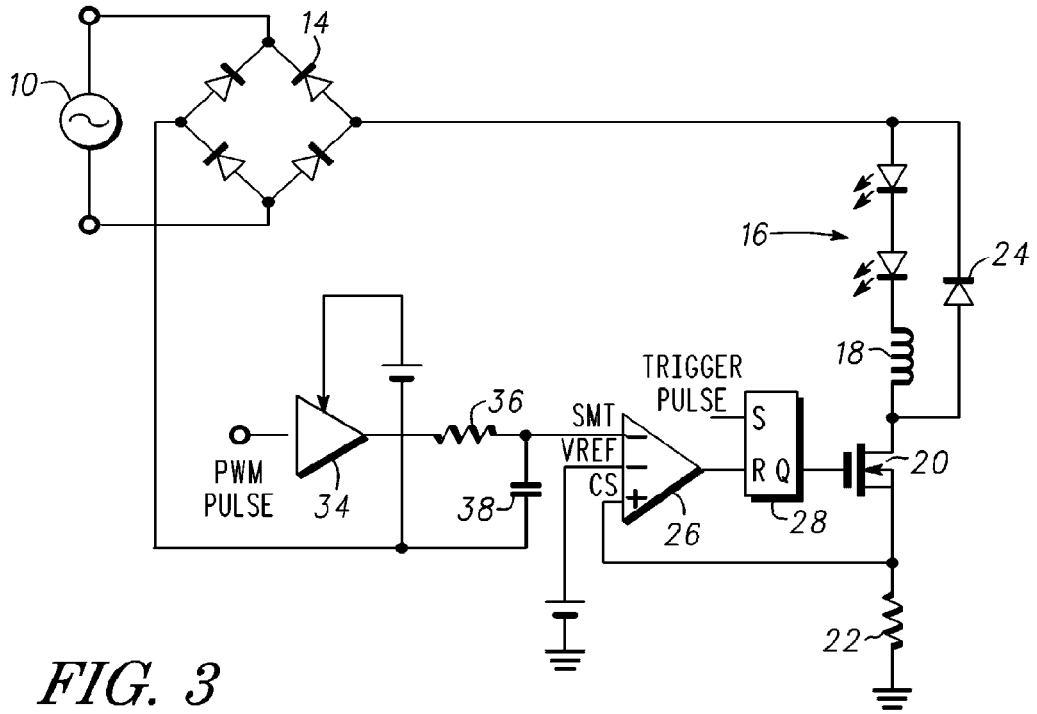
FIG. 3 shows a configuration of yet another embodiment.

FIG. 3 shows yet another embodiment. In this example, the TRIAC dimmer 12 is not used and a PWM signal, which is input from an external source, is used to perform dimming.

Namely, the AC power from the AC power source 10 is supplied intact to the full wave rectifier 14, undergoes full wave rectification and is supplied to the LED array 16. Furthermore, the control transistor 20 is turned on and off by the output of the flip-flop 28.

In this configuration, the output of the flip-flop 28 may be input by an AND gate and the PWM pulse may be input by the AND gate. Thus, the output of the flip-flop 28 turns off in the period where the PWM pulse is an L level and the control transistor 20 is turned off during the period so dimming can be performed.

However, in this case, when the frequency of the PWM pulse drops to near the frequency of the AC voltage, flickering becomes apparent.

The embodiment utilizes the voltage SMT obtained by converting the PWM pulse to DC voltage and controls the switching of the control transistor 20 in the same manner as in the example of FIG. 1.

Namely, the PWM pulse, which is input from an external source, is input by the amplifier 34 where a predetermined offset is applied and the obtained output is supplied via the resistor 36 to the capacitor 38. Then, the obtained DC voltage SMT is input by the second negative input terminal of the comparator 32. This configuration also enables the switching of the control transistor 20 to be controlled using the voltage SMT in the same manner as in the embodiment of FIG. 1. Then, by setting the duty ratio of the PWM pulse signal to correspond to the amount of dimming, an operation substantially similar to that of the configuration of FIG. 1 is obtained.

According to the embodiment, even though the PWM frequency drops to near the frequency of the AC voltage, the duty ratio of the PWM pulse is converted to a DC voltage. Therefore, dimming without flickering becomes possible even if the frequency drops.

Figure 4:
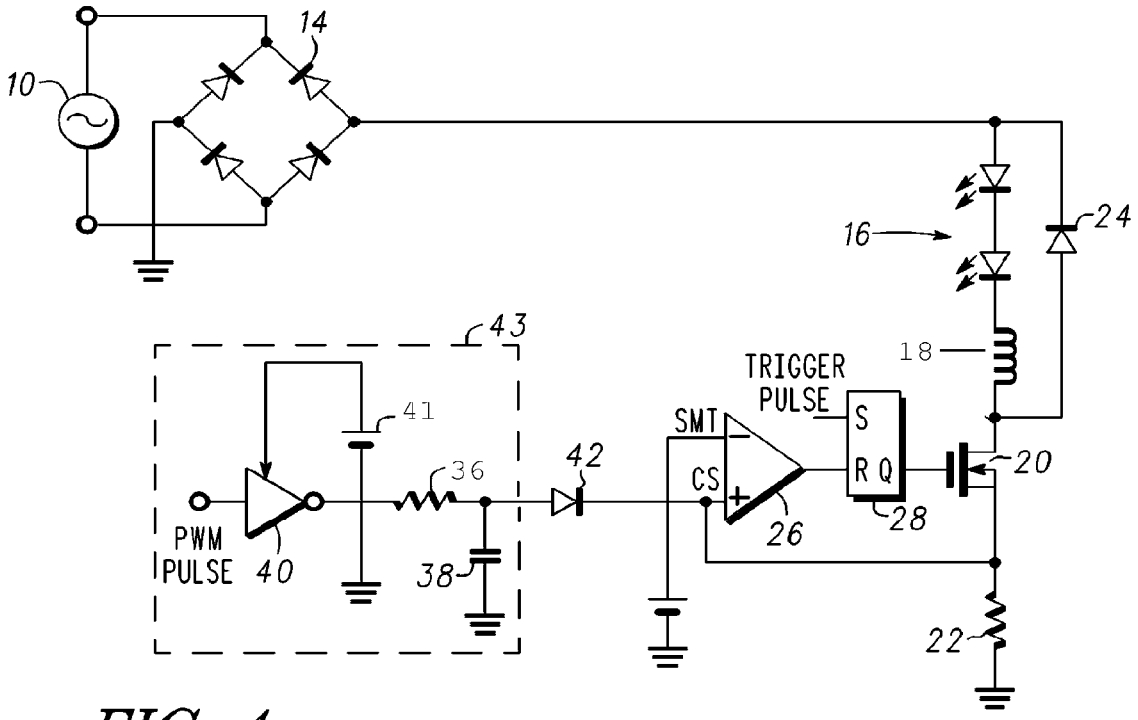
FIG. 4 shows a configuration of yet another embodiment.

FIG. 4 shows yet another embodiment. In this example, similar to FIG. 3, the PWM pulse is converted to a DC voltage and then superimposed on the detected voltage CS so that switching of the control transistor 20 is controlled in the same manner as in the example of FIG. 2.

Namely, the PWM pulse, which is input from an external source, is input by the inverter 40, which can adjust the offset voltage and where a predetermined offset is applied and inverted, and the obtained output is applied via the resistor 36 to the capacitor 38. As discussed with reference to FIG. 2, inverter 40, the offset voltage source 41, resistor 34, and capacitor 38 cooperate to form a converter circuit 43. Converter circuit 43 is coupled to current detection resistor 22 through a diode 42, which diode 42 may be referred to as a change circuit. Then, superimposition onto the obtained detected voltage CS is performed. According to this configuration, the larger the duty ratio of the external input pulse for PWM control, the smaller the charging voltage obtained at the capacitor 38. Thus, similar to the embodiment of FIG. 2, the larger the duty ratio of the external input pulse, the output at the comparator 32 becomes an H level at a slower rate. As a result, control is performed so that the control transistor 20 turns off at a slower timing. Then, by using the external input signal as the PWM signal having a duty ratio corresponding to the conduction angle of the TRIAC output from the TRIAC dimmer 12, an operation substantially similar to that of the configuration of FIG. 2 is obtained.

If switching is to be turned off when the PWM pulse is an H level, a simple amplifier may be used instead of the inverter 40.

In this manner, according to the configuration of the embodiment, dimming without flickering becomes possible even if the PWM frequency drops to near the frequency of the AC voltage.

Figure 5:
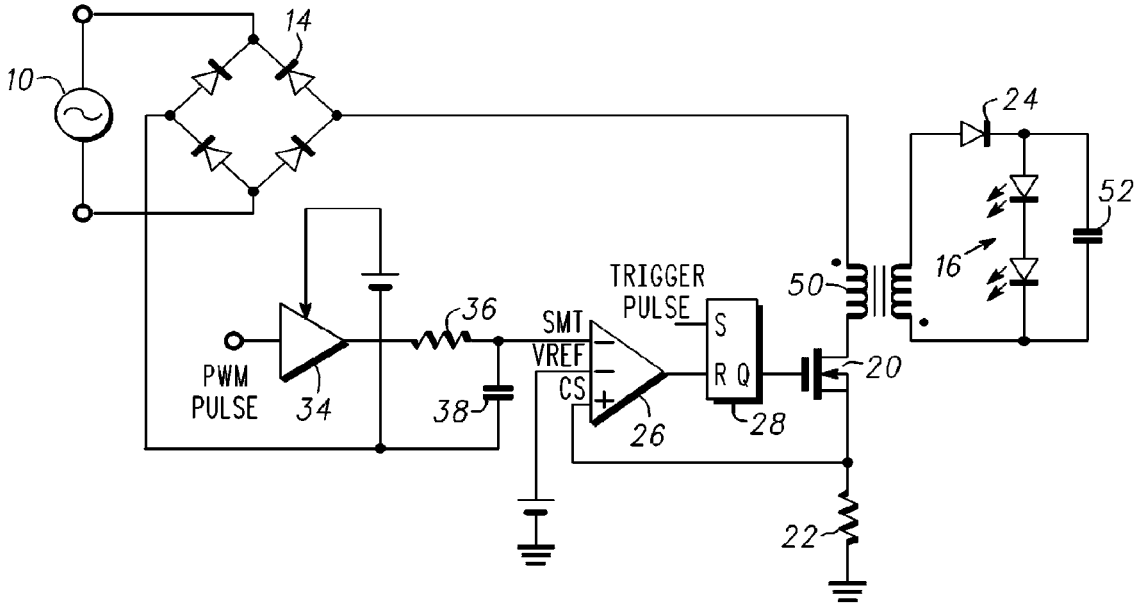
FIG. 5 shows a configuration of yet another embodiment.

FIG. 5 shows a configuration of yet another embodiment. In this example, a transformer 50 is used and is insulated from the drive system for the LED array 16 and the system connected to the AC power source 10. Namely, the forward bias output terminal of the full wave rectifier 14 is connected to one end of the primary coil of the transformer 50 and the other end of the primary coil of the transformer 50 is connected via the control transistor 20 and the current detection resistor 22 to ground. In other words, the LED array 16 is not provided in this path. Therefore, due to the on and off switching of the control transistor 20, an AC current having a frequency corresponding to the output of the full wave rectifier 14 flows to the primary coil of the transformer 50 and an AC current corresponding to the current flowing to the primary coil flows to the secondary coil of the transformer 50.

To one end of the secondary coil of the transformer 50 is connected via the diode 24 the anode of the LED array 16 and to the other end of the secondary coil is connected the cathode of the LED array 16 as well as a capacitor 52 in parallel with the LED array 16.

Therefore, the current flowing to the secondary coil of the transformer 50 is rectified and flows to the LED array 16 via the diode 24 so that the LEDs of the LED array 16 emits light. Furthermore, the current flowing to the LED array 16 is smoothed by the capacitor 52 that is connected in parallel with the LED array 16.

The configuration for switching the control transistor 20 on and off is the same as that of FIG. 3.

According to the configuration of FIG. 5, since the LED array 16 is separate from the power source system, touching the LEDs is safe. In particular, when a 200 V system is used for the AC power source 10, it is preferable to separate the LED drive system from the power source system.

Furthermore, the current control system for the primary coil of the transformer 50 in the power source system in this example has the configuration of FIG. 3 and can also be applied in the same manner to the configurations of FIGS. 1, 2, and 4.

Then, also in the case where the transformer 50 is used, by converting the control signal to a DC voltage, flickering during LED light emission can be prevented.

The current detection resistor 22 corresponds to a current sensing circuit, the comparator 26 to a comparator circuit, and the circuit from the comparator 26 to the gate of the control transistor 20 to a control circuit. Furthermore, as described hereinabove, a half wave rectifier may be used instead of the full wave rectifier.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A light emitting diode (LED) dimmer circuit for performing LED dimming, comprising:

a current sensing circuit that generates a current sense voltage in response to a drive current flowing in one or more light emitting diodes;

a control transistor for switching said drive current on and off;

a comparator circuit for comparing said current sense voltage detected by the current sensing circuit and a predetermined value;

a control circuit for turning off said control transistor in response to said current sense voltage exceeding said predetermined value in accordance with a comparison result of the comparator circuit and turning on said control transistor in response to a trigger pulse being applied;

a converter circuit for converting a pulse to a DC voltage signal; and a diode coupled between the converter circuit and the current sensing circuit, wherein said diode changes said current sense voltage.

2. The LED dimmer circuit according to claim 1, wherein: said current sensing circuit detects a voltage change at a current detection resistor connected in series with said LED.

3. The LED dimmer circuit according to claim 1, wherein: said converter circuit voltage divides a TRIAC pulse to obtain a divided voltage and integrates the obtained divided voltage to generate said DC voltage.

4. The LED dimmer circuit according to claim 1, wherein the diode is configured to change said predetermined value.

5. The LED dimmer circuit according to claim 1, wherein said diode applies an output of said converter circuit to said voltage drop voltage of said current detection resistor to change said drive current value.

6. A light emitting diode (LED) dimmer circuit comprising:

a control transistor for switching a drive current on and off;

a current sensing circuit configured to detect a drive current level of the drive current flowing in the control transistor and generate a current sense voltage;

a control circuit for comparing said drive current value detected by the current sensing circuit and a predetermined value and configured to turn off said control transistor in response to said current sense voltage exceeding said predetermined value and to turn on said control transistor in response to a trigger pulse being applied;

a converter circuit for converting a pulse width modulation signal that is input from an external source and indicates a dimming degree to a DC voltage signal; and a diode coupled between the converter circuit and the current sensing circuit, wherein the diode is configured to change said current sense voltage.

7. The LED dimmer circuit according to claim 6, wherein the diode is configured to change a voltage drop at a current detection resistor connected in series with said control transistor.

8. The LED dimmer circuit according to claim 6, wherein: said converter circuit divides a TRIAC pulse according to a resistance to obtain a divided voltage, integrates the obtained divided voltage, and obtains said DC voltage signal.

9. The LED dimmer circuit according to claim 7, wherein the diode is configured to apply an output of said converter circuit to said current sense voltage of said current detection resistor to change said current sense voltage.

10. The LED dimmer circuit according to claim 6, wherein the diode is configured to change said predetermined value.

11. The LED dimmer circuit according to claim 1, wherein the converter circuit comprises an amplifier having a power supply terminal coupled for receiving a source of operating potential.

12. The LED dimmer circuit of claim 1, wherein the comparator circuit comprises a comparator having a first inverting input, a second inverting input, and a non-inverting input, and wherein the first inverting input is coupled for receiving a reference voltage, the second inverting input is coupled for receiving the predetermined value, and the non-inverting input is coupled for receiving the current sense voltage.

13. A method for mitigating flicker, comprising:

generating a direct current (DC) voltage in response to an input signal;

generating a current sense voltage in response to a current flowing through at least one light emitting diode;

superimposing a control voltage on the current sense voltage through a diode in response to a conduction angle of a TRIAC, wherein superimposing the control voltage based on the current sense voltage increases or decreases the current sense voltage;

generating a control signal to control the current flowing through the at least one light emitting diode by turning off a circuit that generates the current that flows through the at least one light emitting diode in response to the current sense voltage with the superimposed control voltage being greater than the first reference voltage.

14. The method of claim 13, further including turning on the circuit that generates the current that flows through the at least one light emitting diode in response to the current sense voltage with the superimposed control voltage being less than the first reference voltage.

15. The method of claim 13, wherein generating the DC voltage in response to the input signal further includes:

applying a predetermined offset to the input signal to form an adjusted input signal;

generating an integrated voltage in response to the adjusted input signal, wherein the integrated voltage serves as the DC voltage.

16. The method of claim 15, wherein the input signal is a PWM pulse.

17. The method of 15, further including adjusting the current sense voltage to generate an adjusted current sense voltage, wherein generating a control signal to control the current flowing through the at least one light emitting diode by turning off a circuit that generates the current that flows through the at least one light emitting diode in response to the DC voltage being greater than a first reference voltage and in response to the current sense voltage being greater than the first reference voltage includes generating the control signal to control the current flowing through the at least one light emitting diode by turning off the circuit that generates the current that flows through the at least one light emitting diode in response to the DC voltage being greater than a first reference voltage and in response to the adjusted current sense voltage being greater than the first reference voltage.

18. The method of claim 13, wherein the input signal is a derived from a TRIAC dimmer.

* * * * *